US011629712B2

(12) United States Patent
Koh et al.

(10) Patent No.: US 11,629,712 B2
(45) Date of Patent: Apr. 18, 2023

(54) FLUID TRANSFER DEVICE

(71) Applicant: KOREA ATOMIC ENERGY RESEARCH INSTITUTE, Daejeon (KR)

(72) Inventors: Yongkwon Koh, Daejeon (KR); Jangsoon Kwon, Goyang-si (KR); Kyuseok Song, Daejeon (KR); Kijong Jang, Daejeon (KR); Bongju Kim, Gwangju (KR)

(73) Assignee: KOREA ATOMIC ENERGY RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 17/333,201

(22) Filed: May 28, 2021

(65) Prior Publication Data

US 2021/0372403 A1 Dec. 2, 2021

(30) Foreign Application Priority Data

Jun. 1, 2020 (KR) ..... 10-2020-0066008

(51) Int. Cl.
*F04C 23/00* (2006.01)
*F04C 18/22* (2006.01)
(Continued)

(52) U.S. Cl.
CPC ..... *F04C 23/001* (2013.01); *F04C 18/22* (2013.01); *F04C 29/0057* (2013.01);
(Continued)

(58) Field of Classification Search
CPC ..... F04C 18/22; F04C 29/0057; F04C 29/12; F04C 2240/20; F04C 2240/30; F04C 15/06; F04C 2/22; F04C 25/02; F04C 11/001
(Continued)

(56) References Cited

U.S. PATENT DOCUMENTS 3,782,868 A * 1/1974 LeBlanc, Jr. ..... F04C 29/02 418/83
3,883,273 A * 5/1975 King ..... F04C 29/12 418/60
(Continued)

FOREIGN PATENT DOCUMENTS

GB 2088957 A * 6/1982 ..... F04C 18/126
JP 58077191 A * 5/1983 ..... F04C 18/22
(Continued)

OTHER PUBLICATIONS

KIPO, Notice of Allowance of 10-2020-0066008 dated May 10, 2021.
KAERI, Search Report of 10-2020-0066008 conducted by KAERI dated Jan. 30, 2020.

*Primary Examiner* — Devon C Kramer
*Assistant Examiner* — Wesley G Harris
(74) *Attorney, Agent, or Firm* — Lex IP Meister, PLLC

(57) ABSTRACT

The present disclosure describes a rotary pulsation generator having a simple structure capable of transferring fluid while implementing low noise and low vibration and having high flow of fluid and high pressure suction and discharge functions. According to the present disclosure, fluid is transferred by adjusting a width and interval of pulsation while reducing vibration caused by eccentric rotation of a rotor.

15 Claims, 9 Drawing Sheets

(51) Int. Cl.
*F04C 29/00* (2006.01)
*F04C 29/12* (2006.01)

(52) U.S. Cl.
CPC ..... *F04C 29/12* (2013.01); *F04C 2240/20* (2013.01); *F04C 2240/30* (2013.01)

(58) Field of Classification Search
USPC ..... 418/60, 96, 61.2
See application file for complete search history.

(56) References Cited

U.S. PATENT DOCUMENTS

| | | | | |
|---|---|---|---|---|
| 4,973,233 | A * | 11/1990 | Kurio | F01C 11/002 29/888.012 |
| 6,860,724 | B2 | 3/2005 | Cho et al. | |
| 2008/0226480 | A1* | 9/2008 | Ferran | F04C 23/001 418/5 |

FOREIGN PATENT DOCUMENTS

| | | |
|---|---|---|
| JP | H09209943 | 8/1997 |
| JP | 3777898 | 5/2006 |
| KR | 101655160 | 9/2016 |
| KR | 101881546 | 7/2018 |
| KR | 20190018359 | 2/2019 |
| KR | 102003985 | 7/2019 |
| KR | 102100914 | 4/2020 |
| KR | 102109749 | 5/2020 |

* cited by examiner (a)

(b)

(a)

(b)

FLUID TRANSFER DEVICE

CROSS-REFERENCE TO RELATED APPLICATION

Pursuant to 35 U.S.C. § 119(a), this application claims the benefit of the earlier filing date and the right of priority to Korean Patent Application No. 10-2020-0066008, filed on Jun. 1, 2020, the contents of which is incorporated by reference herein in its entirety.

BACKGROUND

1. Technical Field

The present disclosure describes a fluid transfer device configured to generate pulsation by intaking and compressing fluid.

2. Description of the Related Art

In 1951, the German engineer Felix Wankel completed a principle of a rotary engine capable of producing power by rotating a triangular rotor. The so-called Wankel engine is an engine in which a triangular rotor rotates eccentrically to realize rotational power while intake, compression, combustion, and exhaust are simultaneously performed according to volume change in three spaces divided by the triangular rotor inside a cylinder having an epitrochoid surface. The Wankel engine has an advantage of having low power loss and achieving high output power and smooth rotation, because the engine does not have a reciprocating motion of a piston.

Patent Documents, Korean Patent Laid-open Publication No. 10-1655160 (Sep. 1, 2016) and Korean Patent Laid-open Publication No. 10-1881546 (Jul. 18, 2018) disclose a rotary piston pump using such a principle of Wankel engine. The rotary piston pump disclosed in the above patent documents is configured to compress and expand variable-volume spaces in a rotor housing while a triangular rotor rotates eccentrically inside the rotor housing having an epitrochoid inner circumferential surface.

In addition, a fluid transfer device capable of generating high pressure and vacuum without a check valve by serially connecting a combination of a rotor housing and a triangular rotor while using the principle of Wankel engine has been disclosed in Korean Patent Laid-open Publication No. 10-2003985 and Korean Patent Laid-open Publication No. 10-2100914.

Such a rotary piston pump is capable of generating high pressure as well as transferring a relatively high flow of fluid compared to an existing piston type pump. Such a pulsation pump is a device that pumps fluid by converting a rotational motion of a motor into a reciprocating motion of a pumping means such as a diaphragm or a piston by using a cam or crankshaft, and is used in a blood dialyzing apparatus, a fountain device, a washer, an oral cleaner, a medical device, or a skincare or haircare device.

In addition, various pulsation pumps with a pulsating function and capable of stably discharging fluid have been proposed. However, most of pulsation pumps convert rotary motion into linear motion by a piston method, and accordingly, an eccentric shaft, a piston, and a piston rod should be basically configured. This makes the structure complex. In addition, vibration is inevitably generated in the pump due to the linear motion, and this may degrade an airtightness of the piston in the pulsation pump. In the rotary piston pump, as fluid is transferred by volume change due to an eccentric rotation of the triangular rotor, vibration and pulsation are inevitably generated by the eccentric rotation and volume change, and this may result in generating noise.

With this reason, there needs to develop a fluid transfer device capable of realizing low noise and low vibration by reducing vibration and pulsation while maintaining a high flow of fluid, suction (vacuum) and pressurization functions, which are advantages of the rotary piston pump.

SUMMARY

An aspect of the present disclosure is to provide a rotary pulsation generator having a simple structure capable of transferring fluid while implementing low noise and low vibration and having a high flow of fluid and high pressure suction and discharge functions.

Another aspect of the present disclosure is to provide a rotary pulsation generator capable of transferring fluid by adjusting a width and interval of pulsation while reducing vibration caused by eccentric rotation of a rotor.

In order to achieve the aspect and other advantages, there is provided a fluid transfer device including a first fluid entrance housing into which fluid is introduced through an inlet formed at one side of the first fluid entrance housing, and a second fluid entrance housing disposed to be spaced apart from the first fluid entrance housing and configured to compress and discharge the introduced fluid, a rotating shaft including a rotating portion extending in an axial direction, and a first eccentric portion and a second eccentric portion disposed to be spaced apart from each other along the rotating portion, a first rotor housing defining a first fluid compression space having an epitrochoid surface, a second rotor housing defining a second fluid compression space having an epitrochoid surface and disposed to be spaced apart from the first rotor housing in the axial direction, a first rotor disposed in the first fluid compression space so as to divide the first fluid compression space into a plurality of variable-volume spaces and coupled to the first eccentric portion while surrounding the first eccentric portion in a radial direction of the first eccentric portion, a second rotor disposed in the second fluid compression space so as to divide the second fluid compression space into a plurality of variable-volume spaces and coupled to the second eccentric portion while surrounding the second eccentric portion in a radial direction of the second eccentric portion, and rotor housing covers disposed to cover opposite surfaces of the first rotor housing and opposite surfaces of the second rotor housing, respectively. Wherein an inner side surface of the first rotor housing and an inner side surface of the second rotor housing each may be provided with a pothole.

According to the present disclosure having the configuration as described above, high-pressure fluid can be transferred from one end to another end of a fluid transfer device.

In addition, a configuration of a rotor, a rotor housing, a rotor housing cover, and a fluid entrance housing is modularized to make the structure simple, thereby implementing easy manufacturing and maintenance, and cost reduction.

In addition, a fluid transfer device of the present disclosure is capable of reducing vibration and noise caused by an eccentric rotation of a rotor with a structure in which a first rotor and a second rotor are disposed symmetrically with each other with respect to a rotating shaft and channels are connected through a channel housing.

In addition, the fluid transfer device of the present disclosure is capable of controlling an amount of fluid movement by means of a pothole formed in a rotor housing, and controlling magnitude and interval of pulsation.

Figure 4:
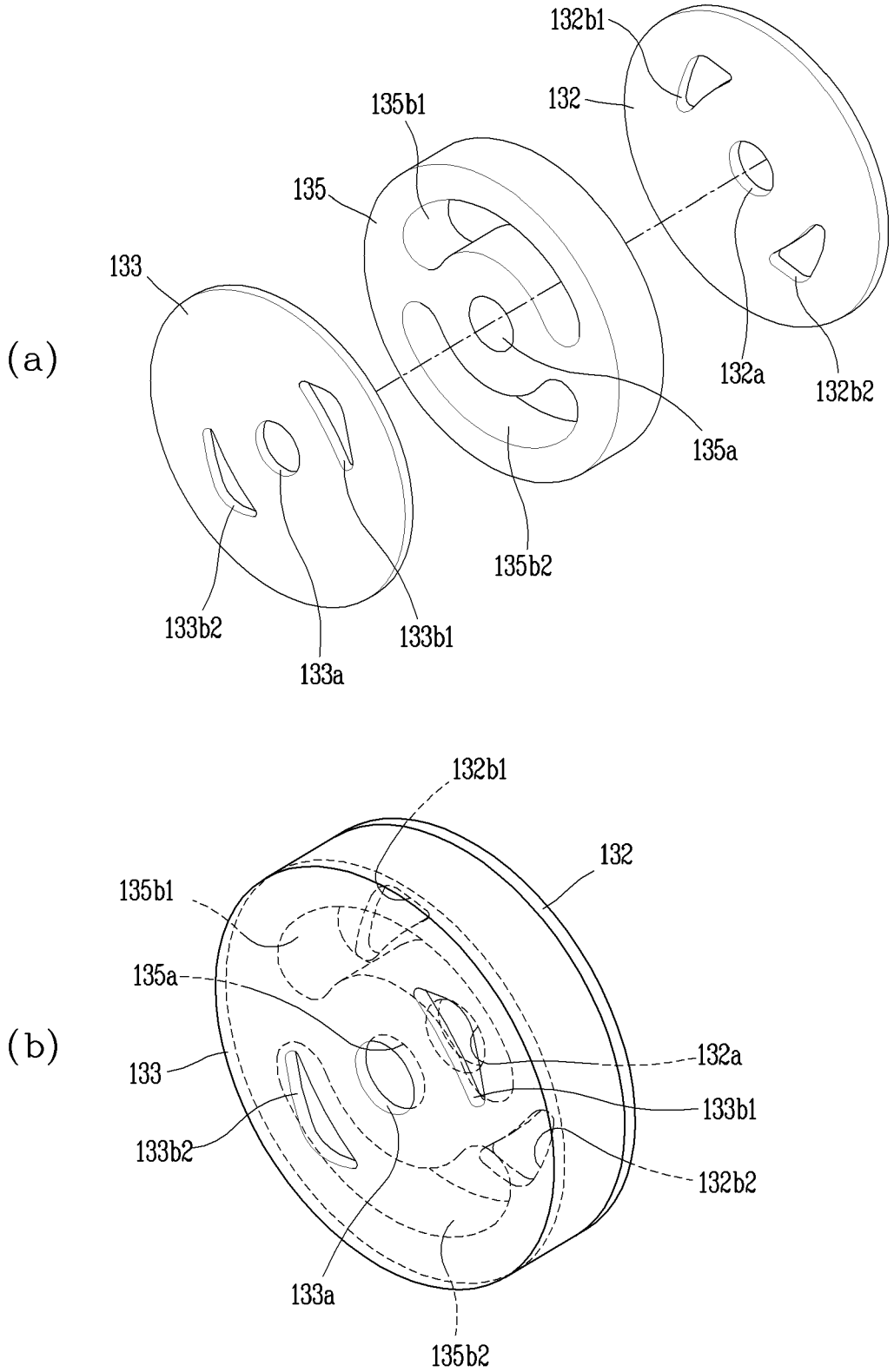

(a) of FIG. 4 is a conceptual view illustrating a state in which a second rotor housing cover and a third rotor housing cover are being coupled to opposite sides of a channel housing, and (b) of FIG. 4 is a conceptual view illustrating a state in which the second rotor housing cover and the third rotor housing cover are coupled to the opposite sides of the channel housing.

Figure 5:
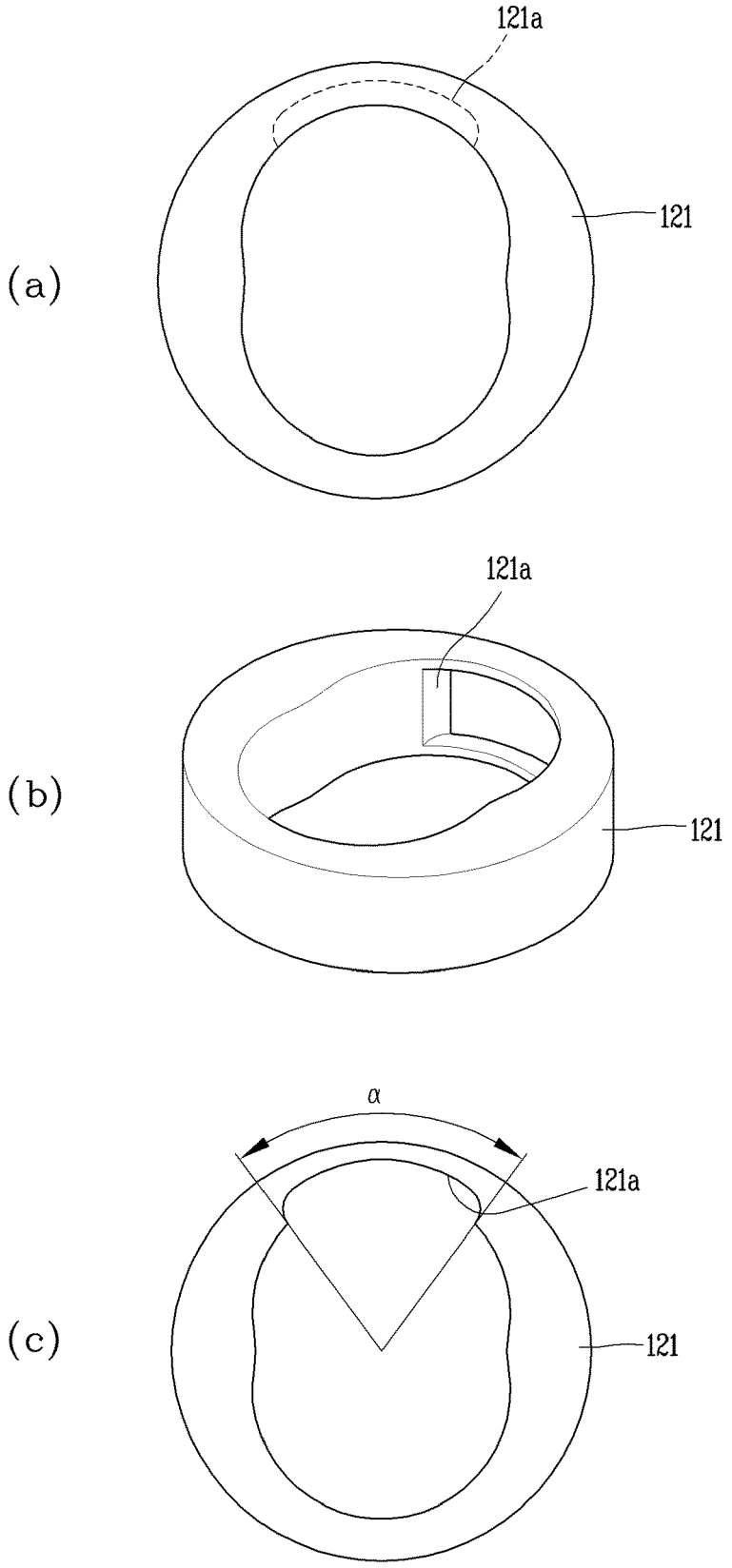

(a) of FIG. 5 is a front view of a first rotor housing, (b) of FIG. 5 is a perspective view of the first rotor housing, and (c) of FIG. 5 is a conceptual view illustrating a pothole formed in the first rotor housing.

Figure 6:
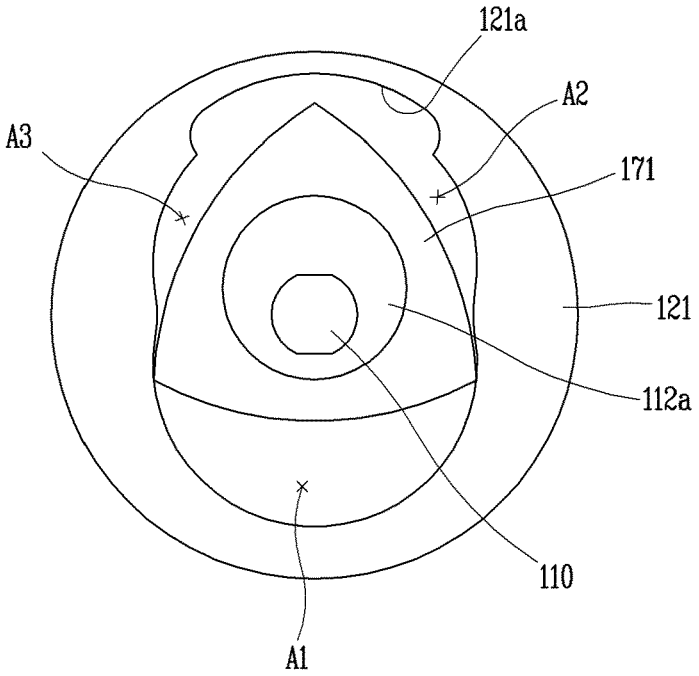
Figure 6:
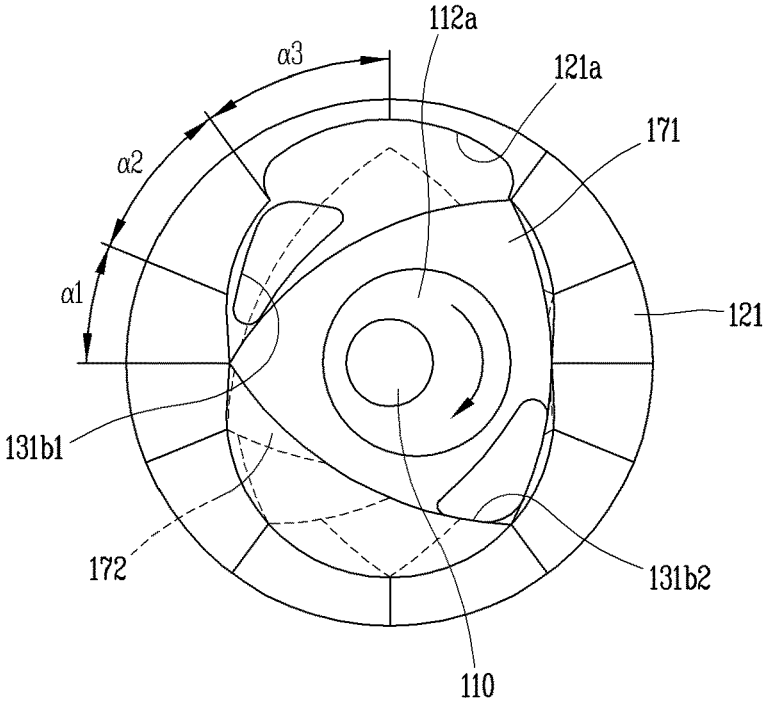

(a) of FIG. 6 is a conceptual view illustrating a state in which a first rotor is located in the first rotor housing, and (b) of FIG. 6 is a conceptual view illustrating a state in which the first rotor moves inside the first rotor housing.

Figure 7:
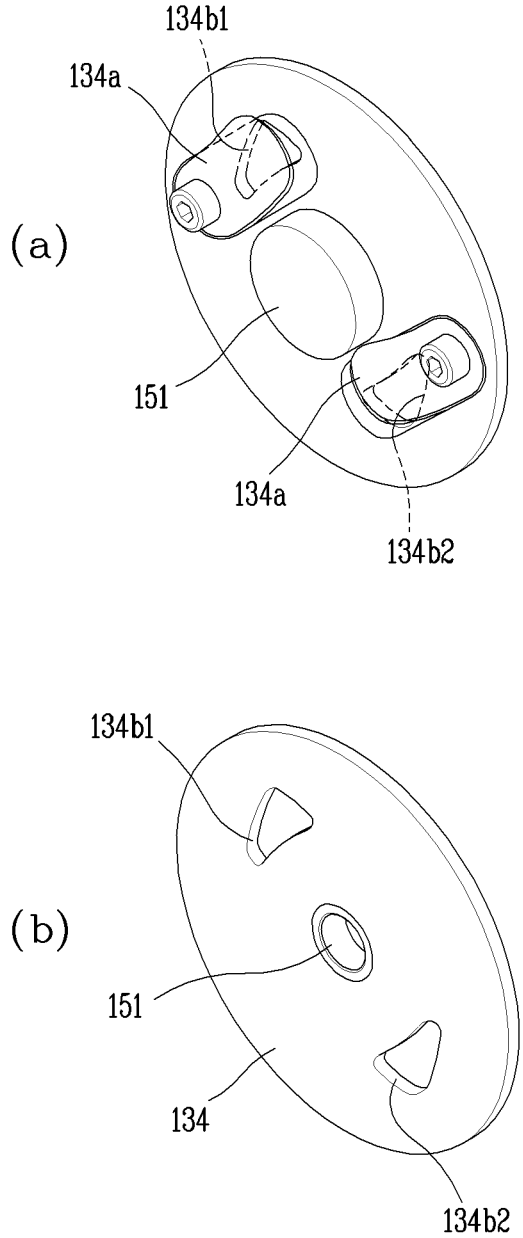

(a) of FIG. 7 is a conceptual view illustrating a rear surface portion of a fourth rotor housing cover, and (b) of FIG. 7 is a conceptual view illustrating a front surface portion of the fourth rotor housing cover.

Figure 8:
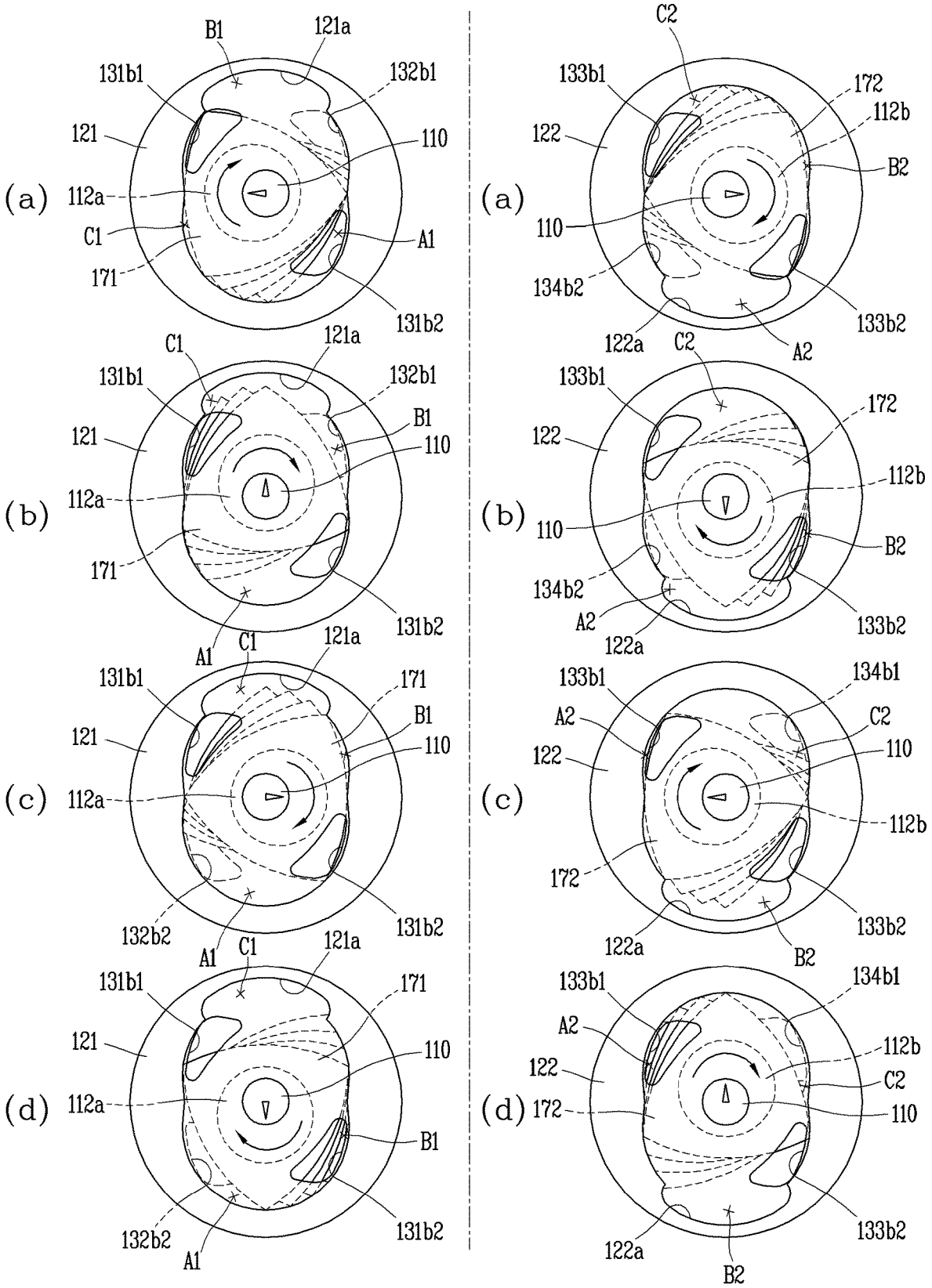

FIG. 8 is a conceptual view sequentially illustrating a process in which fluid introduced into the fluid transfer device is discharged.

Figure 9:
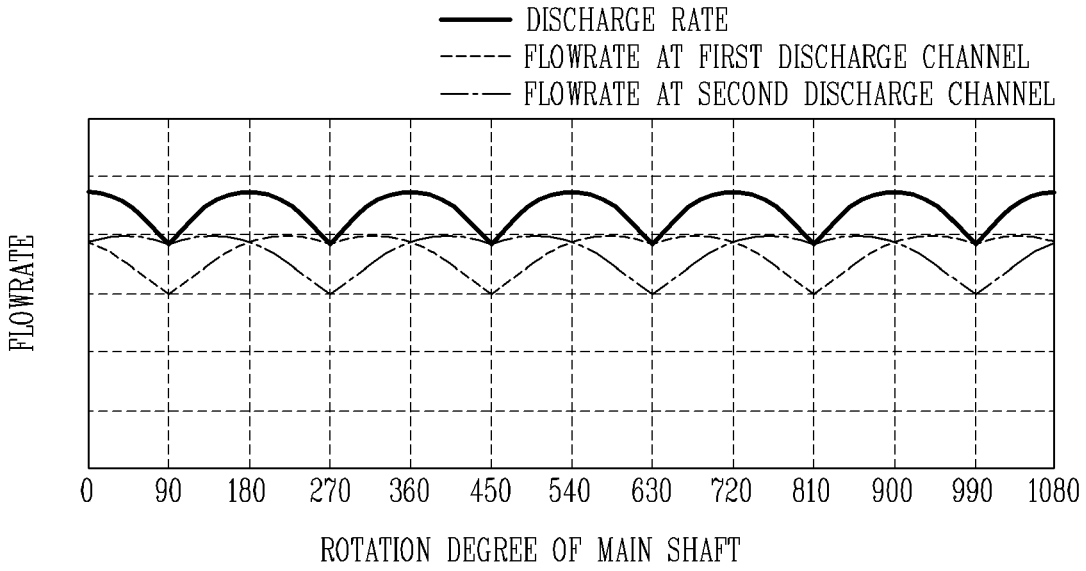
Figure 9:
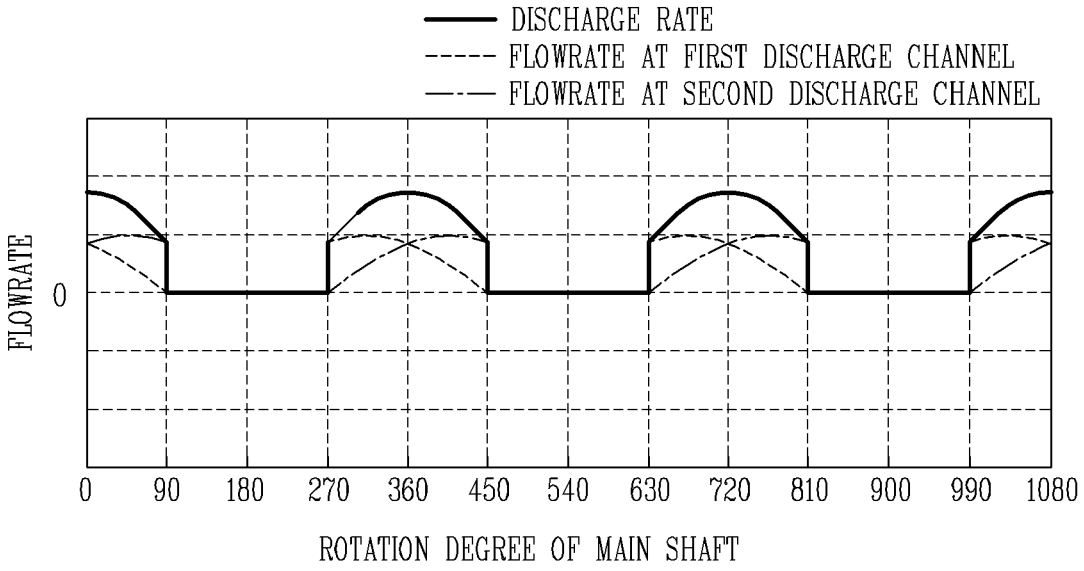

FIG. 9 is a graph showing variations of outflow amount of fluid generated according to rotation degrees.

Figure 10:
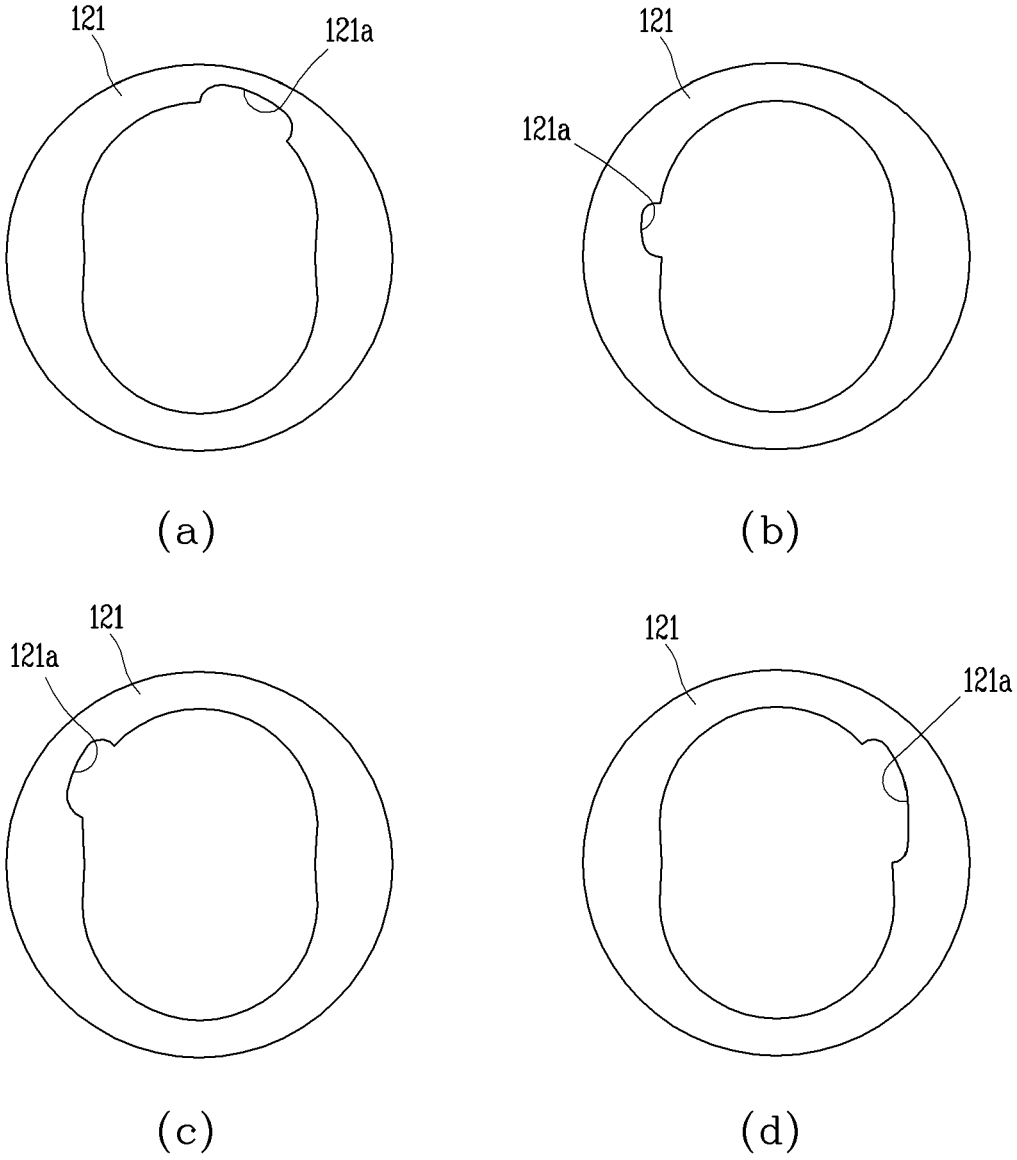

FIG. 10 is a view illustrating various modified embodiments of a pothole formed on an inner side surface of the first rotor housing.

DETAILED DESCRIPTION OF THE PREFERRED EMBODIMENT

Hereinafter, embodiments of the present disclosure will be described in detail with reference to the accompanying drawings, and the same reference numerals are used to designate the same/like components and redundant description thereof will be omitted. In general, a suffix such as "module" and "unit" may be used to refer to elements or components. Use of such a suffix herein is merely intended to facilitate description of the specification, and the suffix itself is not intended to give any special meaning or function. In describing the present disclosure, if a detailed explanation for a related known function or construction is considered to unnecessarily divert the gist of the present disclosure, such explanation has been omitted but would be understood by those skilled in the art. The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the another element or intervening elements may also be present. In contrast, it will be understood that when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
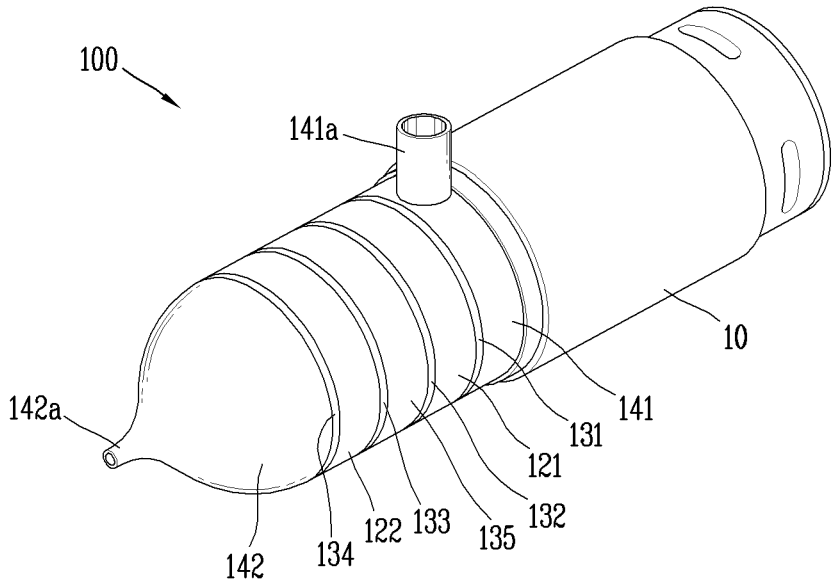
FIG. 1 is a perspective view illustrating an exterior appearance of a fluid transfer device.
Figure 2:
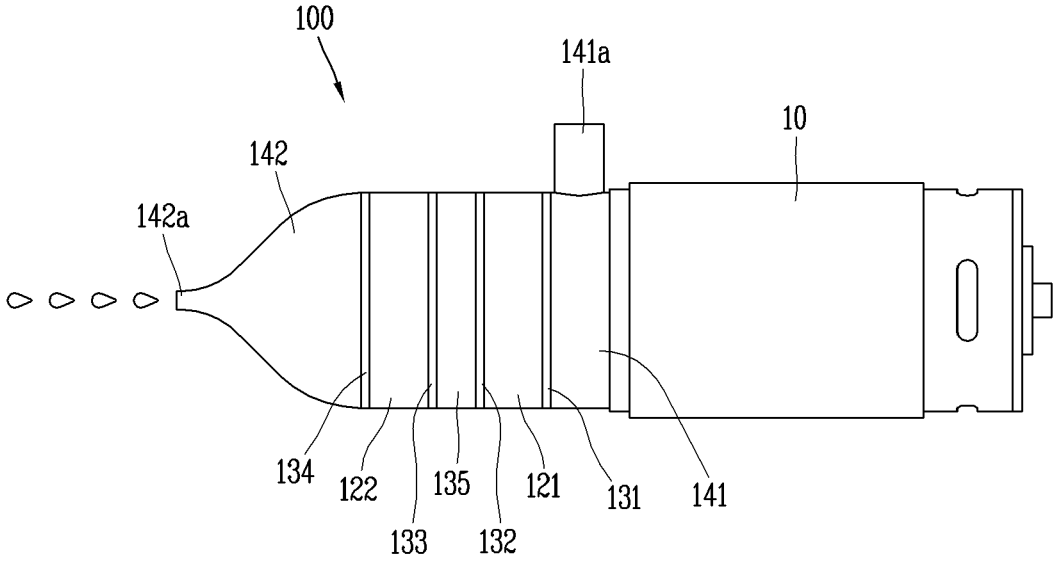
FIG. 2 is a lateral view of the fluid transfer device.
Figure 3:
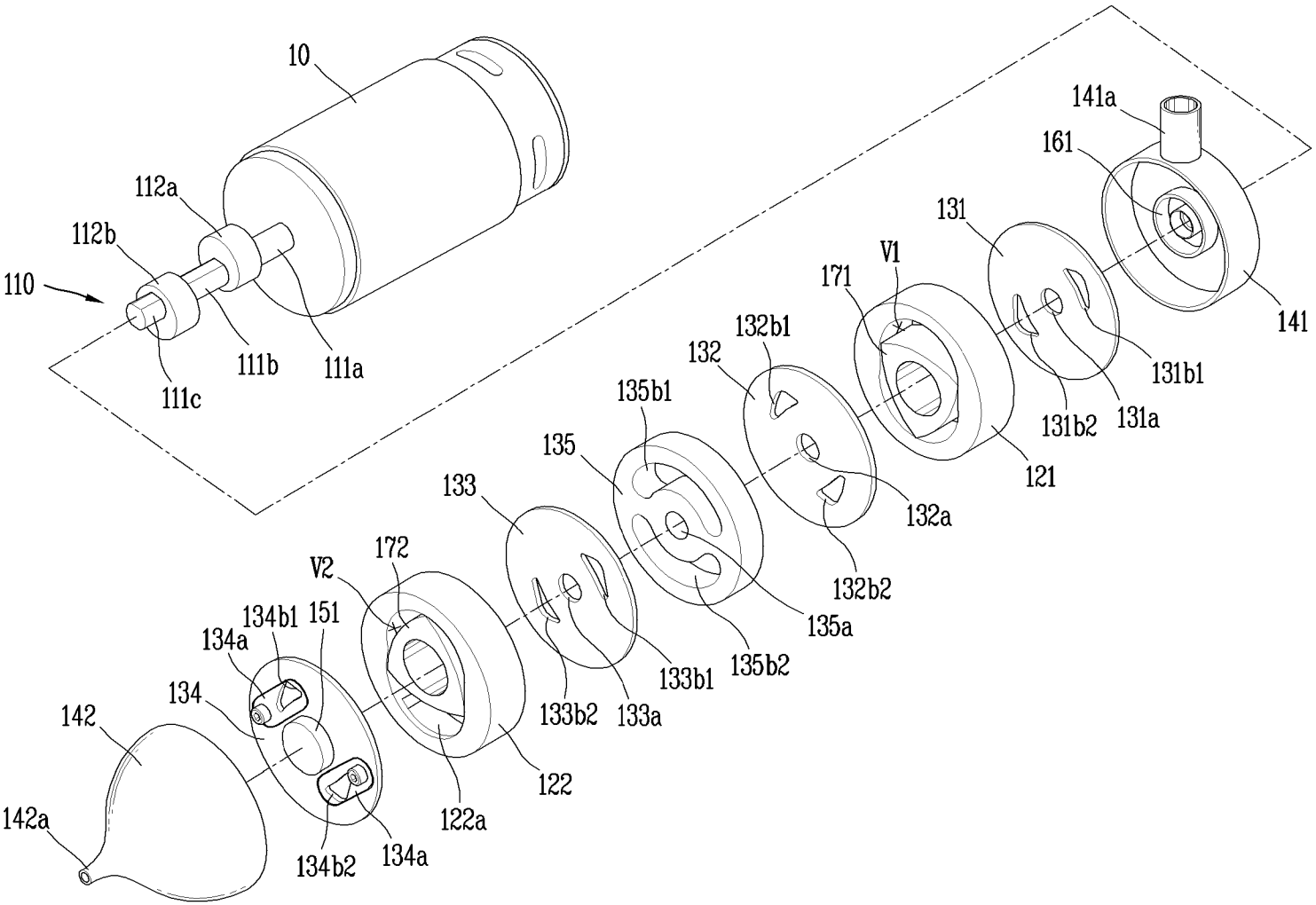
FIG. 3 is an exploded perspective view of the fluid transfer device.

FIG. 1 is a perspective view illustrating an exterior appearance of a fluid transfer device 100, and FIG. 2 is a lateral view of the fluid transfer device 100. And, FIG. 3 is an exploded perspective view of the fluid transfer device 100. In addition, (a) of FIG. 4 is a conceptual view illustrating a state in which a second rotor housing cover 132 and a third rotor housing cover 133 are being coupled to opposite sides of a channel housing 135, and (b) of FIG. 4 is a conceptual view illustrating a state in which the second rotor housing cover 132 and the third rotor housing cover 133 are coupled to the opposite sides of the channel housing 135.

The fluid transfer device 100 according to the present disclosure may perform a function as a rotary piston pump capable of, such as, generating a high pressure after sucking fluid, and transferring high flow of fluid.

The appearance of the fluid transfer device 100 may have a cylindrical shape as illustrated in FIG. 1, but may not be limited thereto.

The fluid transfer device 100 may include a rotating shaft 110, a rotor housing 121, 122, the channel housing 135, a rotor housing cover 131, 132, 133, 134, and a fluid entrance housing 141, 142.

As illustrated in FIGS. 1 to 3, in the fluid transfer device 100, fluid introduced from a first fluid entrance housing 141 located at a rear portion may be compressed by a rotor 171, 172 being moved by the rotating shaft 110 in the rotor housing 121, 122, so as to be sprayed at high pressure through a second fluid entrance housing 142 located at a front portion while having regular pulsation intervals.

The rotor housing 121, 122 may have a compression space having an inner surface with an epitrochoid curve.

The rotor housing 121, 122 may include a first rotor housing 121 and a second rotor housing 122. Here, the first rotor housing 121 and the second rotor housing 121 may be disposed in a moving direction of fluid, and as illustrated in FIGS. 1 to 3, the first rotor housing 121 may be located closer to the rear portion (or right side in the drawing) than the second rotor housing 122.

The rotor housing cover 131, 132, 133, 134 may be disposed to cover opposite surfaces of the first rotor housing and opposite surfaces of the second rotor housing, respectively, and may be provided in plurality.

The rotor housing cover 131, 132, 133, 134 may include a first rotor housing cover 131, a second rotor housing cover 132, a third rotor housing cover 133, and a fourth rotor housing cover 134.

In addition, the fluid entrance housing 141, 142 may be provided in plurality, and may include the first fluid entrance housing 141 that is located at the front portion and serves to introduce fluid from outside, and the second fluid entrance housing 142 that sprays compressed high-pressure fluid.

As illustrated in FIG. 3, the fluid transfer device 100 has a structure in which the first fluid entrance housing 141, the first rotor housing cover 131, the first rotor housing 121, the second rotor housing cover 132, the channel housing 135, the third rotor housing cover 133, the second rotor housing 122, the fourth rotor housing cover 134, the second fluid entrance housing 142 are sequentially arranged from one end toward another end of the fluid transfer device 100.

In addition, as illustrated in FIG. 3, the rotating shaft 110 may be coupled to a rear end of the fluid transfer device 100, thereby forming a rotation of the rotor 171, 172 to be described later.

The first fluid entrance housing 141 may be disposed at a rear portion of the fluid transfer device 100, and the second fluid entrance housing 142 may be disposed at a front portion of the fluid transfer device 100. The first fluid entrance housing 141 and the second fluid entrance housing 142 define an outer surface of the fluid transfer device 100.

The first fluid entrance housing 141 and the second fluid entrance housing 142 each may be provided with a fluid entrance 141*a* or 142*a*. The fluid entrance 141*a*, 142*a* may protrude from an outer circumferential surface of the fluid entrance housing 141, 142.

The outer circumferential surface of the first fluid entrance housing 141 may be provided with a first fluid entrance 141*a* protruding therefrom. The first fluid entrance 141*a* may also be referred to as an inlet because fluid may be introduced therethrough from outside.

A front portion of the second fluid entrance housing 142 may be provided with a second fluid entrance 142*a* protruding therefrom to discharge compressed fluid. The second fluid entrance 142*a* may also be referred to as an outlet because compressed fluid may be discharged therethrough.

The rotor housing covers 131, 132, 133, and 134 may be disposed to be spaced apart from one another. The rotor housings 121 and 122 and the channel housing 135 may be disposed between each of the rotor housing covers 131, 132, 133, and 134.

The rotor housing covers 131, 132, 133, and 134, the rotor housings 121 and 122, and the channel housing 135 may be sequentially disposed.

For example, as illustrated in FIGS. 1 to 3, the fluid transfer device 100 according to the present disclosure may include the first rotor housing cover 131, the first rotor housing 121, the rotor housing cover 132, the channel housing 135, the third rotor housing cover 133, the second rotor housing 122, and the fourth rotor housing cover 134 arranged in order in a direction from the rear portion to the front portion.

The rotor housing covers 131, 132, 133, and 134, the rotor housings 121 and 122, and the channel housing 135 together with the fluid entrance housings 141 and 142 may define a continuous exterior appearance of the fluid transfer device 100.

The rotating shaft 110 penetrating the fluid transfer device 100 may be connected to a power source such as a motor or a generator to receive rotational driving force from the power source, and may be rotated by the received rotational driving force.

The rotating shaft 110 may penetrate a center of the fluid transfer device 100, so that one end thereof is disposed inside the fluid transfer device 100 and another end thereof is installed to be exposed outwardly of the fluid transfer device 100.

The rotating shaft 110 may include a rotating portion 111*a*, 111 *b*, 111*c* rotating in place in one direction and an eccentric portion 112*a*, 112*b* rotating eccentrically.

The rotating portion 111*a*, 111*b*, 111*c* extends in an axial direction. The axial direction refers to a direction extending from one end to another end of the rotating portion 111*a*, 111*b*, 111*c*, or a direction reverse thereto.

The eccentric portion 112*a*, 112*b* eccentrically coupled to the rotating portion 111*a*, 111*b*, 111*c* may be configured to rotate eccentrically about the rotating portion 111*a*, 111*b*, 111*c* as the rotating portion 111*a*, 111*b*, 111*c* rotates in place.

The rotating portion 111*a*, 111*b*, 111*c* (or a first rotating portion 111*a*, a second rotating portion 111*b*, and a third rotating portion 111*c*) and the eccentric portion 112*a*, 112*b* (or a first eccentric portion 112*a* and a second eccentric portion 112*b*) may be alternately disposed in the axial direction.

The first rotating portion 111*a*, the second rotating portion 111*b*, and the third rotating portion 111*c* may be alternately arranged with the first eccentric portion 112*a* and the second eccentric portion 112*b*, thereby allowing the first rotating portion 111*a*, the second rotating portion 111*b*, and the third rotating portion 111*c* to be disposed at positions spaced apart from one another. The first eccentric portion 112*a* and the second eccentric portion 112*b* may also be disposed at positions spaced apart from each other in the axial direction.

The first eccentric portion 112*a* may be disposed between the first rotating portion 111*a* and the second rotating portion 111*b* in the axial direction. The second eccentric portion 112*b* may be disposed between the second rotating portion 111*b* and the third rotating portion 111*c* in the axial direction.

Relative positions of the first eccentric portion 112*a* and the second eccentric portion 112*b* may be defined by projecting the rotating shaft 110 onto a plane in a direction from one end toward another end of the rotation shaft 110.

As the first eccentric portion 112*a* and the second eccentric portion 112*b* are eccentrically coupled to the rotating portion 111*a*, 111 *b*, 111*c*, a distance from a center of the rotating portion 111*a*, 111*b*, 111*c* to an outer circumferential surface of the eccentric portion 112*a*, 112*b* may not be constant.

Accordingly, a direction having a longest distance among distances from the center of the rotating portion 111*a*, 111 *b*, 111*c* to the outer circumferential surface of the eccentric portion 112*a*, 112*b* may be defined as a direction in which the eccentric portion 112*a*, 112*b* is formed.

Here, the first eccentric portion 112*a* and the second eccentric portion 112*b* may be disposed to have an angle of 180 degrees about the rotating portion 111*a*, 111 *b*, 111*c*. The first eccentric portion 112*a* and the second eccentric portion 112*b* may be symmetrically disposed about the rotating shaft 110.

In addition, a bearing 151 and a retainer 161 may be installed for smooth rotation and sealing of the rotating shaft 110. The bearing 151 and the retainer 161 each may have an annular shape to surround the rotating shaft 110, and an inner circumferential surface of the retainer 161 may be coupled to the rotating shaft 110. The retainer 161 may be installed in a retainer accommodating hole formed in the first fluid entrance housing 141.

An inner circumferential surface of the bearing 151 may be coupled to the rotating shaft 110. The bearing 151 may be installed in a rotating shaft accommodating hole formed in the second fluid entrance housing 142.

The first rotor housing 121 and the second rotor housing 122 may be disposed at positions spaced apart from each other in the axial direction. The first rotor housing 121 may be disposed at a position corresponding to the first eccentric portion 112*a*, and the second rotor housing 122 may be disposed at a position corresponding to the second eccentric portion 112*b*.

The first rotor housing 121 may have a first fluid compression space V1, and the first fluid compression space V1 may be opened toward the first rotor housing cover 131 and the second rotor housing cover 132.

In addition, the second rotor housing 122 may have a second fluid compression space V2. The second fluid compression space V2 may be opened toward the third rotor housing cover 133 and the fourth rotor housing cover 134.

The first rotor housing 121 and the second rotor housing 122 may have a hollow cylindrical shape or a polygonal pillar shape. When the first rotor housing 121 and the second rotor housing 122 are viewed in the axial direction, an inner circumferential surface of the first rotor housing 121 and an inner circumferential surface of the second rotor housing 122 each may have an epitrochoid shape. Regions in the epitrochoid shape correspond to the first fluid compression space V1 and the second fluid compression space V2, respectively.

The first rotor housing 121 and the second rotor housing 122 may be disposed such that each of the epitrochoid surfaces face the same direction.

Here, the epitrochoid surface refers to a curve drawn by a point of a second circle that rolls on an outside of a first circle while being in contact with the first circle. The epitrochoid shape may vary depending on a size ratio of the first circle and the second circle, and may be shown in various ways.

The epitrochoid refers to a shape of a peanut that satisfies R=2r when a radius of the first circle is R and a radius of the second circle is r. Here, the coefficient 2 corresponds to the number of inflection points (or peak points) appearing in the epitrochoid.

Arrangement directions of the first rotor housing 121 and the second rotor housing 122 may be determined based on a direction in which the epitrochoid curve is facing. For example, when the epitrochoid curve of the first rotor housing 121 and the epitrochoid curve of the second rotor housing 122 are exactly overlapped each other on a plane, it can be said that the first rotor housing 121 and the second rotor housing 122 are arranged to face the same direction.

A first rotor 171 and a second rotor 172 each may have a triangular pillar shape. A shape of the rotor 171, 172 may be similar to an equilateral triangular pillar, but its side surfaces may be understood to be curved surfaces each having a shape convexly outwardly protruding. The curved surfaces correspond to the epitrochoid curve of the rotor housing 121, 122. A triangle having rounded sides like a radial cross section of the first rotor 171 and the second rotor 172 is referred to as a Reuleaux triangle.

The first rotor 171 may be disposed in the first fluid compression space V1 so as to divide the first fluid compression space V1 of the first rotor housing 121 into a plurality of variable-volume spaces.

The second rotor 172 may be disposed in the second fluid compression space V2 so as to divide the second fluid compression space V2 of the second rotor housing 122 into a plurality of variable-volume spaces. Here, the volume is the same term as the capacity of a space accommodating or containing fluid to be compressed. Therefore, the variable-volume space means that a volume or capacity is inconstant and varies in response to the rotation of the rotor 171, 172.

As the first rotor 171 is disposed in the first fluid compression space V1 and the second rotor 172 is disposed in the second fluid compression space V2, the first fluid compression space V1 and the second fluid compression space V2 each may be divided into three variable-volume spaces. As the first rotor 171 and the second rotor 172 rotate, the three variable-volume spaces may change in volume or capacity while repeatedly being compressed and expanded.

The first eccentric portion 112*a* may be disposed in the first fluid compression space V1 of the first rotor housing 121. The first rotor 171 may be coupled to the first eccentric portion 112*a* while surrounding the first eccentric portion 112*a* in a radial direction of the first eccentric portion 112*a*. Likewise, the second eccentric portion 112*b* may be disposed in the second fluid compression space V2 of the second rotor housing 122. The second rotor 172 may be coupled to the second eccentric portion 112*b* while surrounding the second eccentric portion 112*a* in a radial direction of the second eccentric portion 112*a*.

The first rotor 171 may be coupled to the first eccentric portion 112*a* and moved together with the first eccentric portion 112*a*. The second rotor 172 may be coupled to the second eccentric portion 112*b* and moved together with the second eccentric portion 112*b*. The rotating portions 111*a*, 111*b*, and 111*c* of the rotating shaft 110 rotate in place, but the first eccentric portion 112*a* and the second eccentric portion 112*b* rotate eccentrically unlike the rotating portions 111*a*, 111*b*, and 111*c*. Therefore, the first rotor 171 coupled to the first eccentric portion 112*a* and the second rotor 172 coupled to the second eccentric portion 112*b* each may move within an area defined by the epitrochoid curve while rotating about the first eccentric portion 112*a* and the second eccentric portion 112*b*, respectively.

Meanwhile, the fluid transfer device using volume change caused by eccentric rotation of the triangular rotor inside the rotor housing having the epitrochoid curve may transfer a large amount of fluid, but may generate vibration because a rotation center of the rotor and a centroid of the rotor are different from each other due to the eccentric rotation structure of the triangular rotor.

In order to minimize the vibration, the first rotor 171 and the second rotor 172 may be arranged to have a point symmetry about the rotating shaft 110. In other words, as the rotating shaft 110 rotates, the first rotor 171 and the second rotor 172 may always be symmetrical about the rotating shaft 110. Accordingly, since a centrifugal force of the first rotor 171 and a centrifugal force of the second rotor 172 generated by the eccentric rotation in response to the rotation of the rotating shaft 110 are the same, the centrifugal forces generated during the rotation of the first rotor 171 and the second rotor 172 are canceled out from each other.

The fluid transfer device 100 may greatly reduce vibration by arranging the first rotor 121 and the second rotor 122 to be symmetrical about the rotating shaft 110, and connecting channels by the channel housing 135.

In addition, the fluid transfer device 100 according to the present disclosure has a structure in which an inner side surface of the first rotor housing 121 is provided with a pothole 121*a* and an inner side surface of the second rotor housing 122 is provided with a pothole 122*a*. The potholes 121*a* and 122*a* each may have a shape that is recessed from the inner side surfaces of the first rotor housing 121 and second rotor housing 122, and inner spaces of the first rotor housing 121 and the second rotor housing 122 may vary as vertices of the first rotor 121 and vertices of the second rotor 122 are positioned in the potholes 121*a* and 122*a*.

The first rotor housing 121 may be provided with a first pothole 121*a* and the second rotor housing 122 may be provided with a second pothole 122*a*. Detailed description thereof will be given later.

The channel housing 135 may have a fluid communication space 135*b*1, 135*b*2.

The channel housing 135 may be disposed between the first rotor housing 121 and the second rotor housing 122, and may serve to provide a channel so that fluid in the first fluid compression space V1 and the second fluid compression space V2 moves from the first rotor housing 121 to the second rotor housing 122 through the fluid communication space 135*b*1, 135*b*2 according to a rotating direction of the rotating shaft 110.

The fluid communication space 135*b*1, 135*b*2 may include a first communication space 135*b*1 and a second communication space 135*b*2.

The first rotor housing cover 131 may cover the first fluid compression space V1 at one side. The first rotor housing cover 131 may be disposed at one side of the first rotor housing 121. Here, the one side of the first rotor housing 121 refers to a portion between the first fluid entrance housing 141 and the first rotor housing 121.

The second rotor housing cover 132 may cover the first fluid compression space V1 and the fluid communication space 135*b*1, 135*b*2. The second rotor housing cover 132 may be disposed between the first rotor housing 121 and the channel housing 135. One surface of the second rotor housing cover 132 may face the first fluid compression space V1, and another surface of the second rotor housing cover 132 may face the fluid communication space 135*b*1, 135*b*2.

The third rotor housing cover 133 may cover the fluid communication space 135*b*1, 135*b*2. The third rotor housing cover 133 may be disposed between the channel housing 135 and the second rotor housing 122. One surface of the third rotor housing cover 133 may face the fluid communication space 135*b*1, 135*b*2, and another surface of the third rotor housing cover 133 may face the second fluid compression space V2.

The fourth rotor housing cover 134 may cover the second fluid compression space V2. The fourth rotor housing cover 134 is disposed on an opposite side of the third rotor housing cover 133 with respect to the second rotor housing 122. One surface of the fourth rotor housing cover 134 may face the second fluid compression space V2, and another surface of the fourth rotor housing cover 134 may face the second fluid entrance housing 142.

In addition, the fourth rotor housing cover 134 may be provided with a discharge valve 134*a* to allow compressed fluid to be discharged through the outlet 142*a*.

The first rotor housing cover 131, the second rotor housing cover 132, the third rotor housing cover 133, and the fourth rotor housing cover 134 each may have a circular plate shape.

Here, rotating shaft through holes 131*a*, 132*a*, and 133*a* each may be formed in the circular plates, and a rotating shaft accommodating portion may be formed in a central portion of the fourth rotor housing cover 134. Similarly, the channel housing 135 may have a circular plate shape, and a rotating shaft through hole 135*a* may be formed in a central portion of the channel housing 135.

In addition, channels 131*b*1 and 131*b*2, 132*b*1 and 132*b*2, 133*b*1 and 133*b*2, and 134*b*1 and 134*b*2 may be formed in each of the rotor housing covers 131, 132, 133, and 134.

The rotating shaft through holes 131*a*, 132*a*, 133*a*, and 135*a* may be formed through centers of the disk plates in the axial direction. The rotating shaft through holes 131*a*, 132*a*, 133*a*, and 135*a* may accommodate the rotating portions 111*a*, 111*b*, and 111*c* of the rotating shaft 110.

The first rotating portion 111*a* may be accommodated in the rotating shaft through hole 131*a* of the first rotor housing cover 131, and the second rotating portion 111*b* may be accommodated in the rotating shaft through hole 132*a* of the second rotor housing cover 132, the rotating shaft through hole 133*a* of the third rotor housing cover 133, and the rotating shaft through hole 135*a* of the channel housing 135. In addition, the third rotating portion 111*c* may be accommodated in the bearing 151 installed in the rotating shaft accommodating portion of the fourth rotor housing cover 134.

A distance between the first rotor housing cover 131 and the second rotor housing cover 132 in the axial direction corresponds to a thickness of the first rotor 171, and a distance between the third rotor housing cover 133 and the fourth rotor housing cover 134 corresponds to a thickness of the second rotor 172.

The channel 131*b*1, 131*b*2, 132*b*1, 132*b*2, 133*b*1, 133*b*2, 134*b*1, 134*b*2 may be formed through the circular plate in the axial direction. The channel 131*b*1, 131*b*2, 132*b*1, 132*b*2, 133*b*1, 133*b*2, 134*b*1, 134*b*2 may allow fluid to pass therethrough in the axial direction.

The channel 131*b*1, 131*b*2, 132*b*1, 132*b*2, 133*b*1, 133*b*2, 134*b*1, 134*b*2 may be formed in plurality in one rotor housing cover 131, 132, 133, 134.

For example, as illustrated in the drawing, each of the rotor housing covers 131, 132, 133, and 134 may be provided by two channels 131*b*1 and 131*b*2, 132*b*1 and 132*b*2, 133*b*1 and 133*b*2, and 134*b*1 and 134*b*2. The two channels 131*b*1 and 131*b*2, 132*b*1 and 132*b*2, 133*b*1 and 133*b*2, and 134*b*1 and 134*b*2 may be formed in a symmetrical shape at positions symmetrical to each other about each of the rotating shaft through holes 131*a*, 132*a*, 133*a*, and 134*a*.

Here, each of the two channels 131*b*1 and 131*b*2, 132*b*1 and 132*b*2, 133*b*1 and 133*b*2, and 134*b*1 and 134*b*2 may have a triangular shape corresponding to positions of the first rotor 171 and the second rotor 172. For example, the channel 131*b*1 of the first rotor housing cover may have a shape covered by the first rotor 171 that eccentrically rotates.

Positions of the channels 131*b*1 and 131*b*2, 132*b*1 and 132*b*2, 133*b*1 and 133*b*2, and 134*b*1 and 134*b*2 formed in each of the rotor housing covers 131, 132, 133, and 134 may be described in a manner that the rotor housing covers 131, 132, 133, and 134 are each projected on a coordinate plane in a direction viewing the rotating shaft 110 from one end toward another end. Here, the rotating shaft through holes 131*a*, 132*a*, 133*a*, and 134*a* may lie on a center of the coordinate plane.

For example, one 131*b*1 of the two channels 131*b*1 and 131*b*2 of the first rotor housing cover 131 may lie on a second quadrant, and another one 131*b*2 of the two channels 131*b*1 and 131*b*2 of the first rotor housing cover 131 may lie on a fourth quadrant. One 132*b*1 of the two channels 132*b*1 and 132*b*2 of the second rotor housing cover 132 may lie on a first quadrant, and another one 132*b*2 of the two channels 132*b*1 and 132*b*2 of the second rotor housing cover 132 may lie on a third quadrant. One 133*b*1 of the two channels 133*b*1 and 133*b*2 of the third rotor housing cover 133 may lie on the second quadrant, and another one 133*b*2 of the two channels 133*b*1 and 133*b*2 of the third rotor housing cover 133 may lie on the fourth quadrant. One 134*b*1 of the two channels 134*b*1 and 134*b*2 of the fourth rotor housing cover 134 may lie on the first quadrant, and another one 134*b*2 of the two channels 134*b*1 and 134*b*2 of the fourth rotor housing cover 134 may lie on the third quadrant.

As the two channels 131*b*1 and 131*b*2 of the first rotor housing cover 131 and the two channels 133*b*1 and 133*b*2 of the third rotor housing cover 133 lie on the second quadrant and the fourth quadrant, the two channels 131*b*1 and 131*b*2 of the first rotor housing cover 131 and the two channels 133*b*1 and 133*b*2 of the third rotor housing cover 133 may lie on positions overlapping each other in the axial direction.

In addition, shapes of the two channels 131*b*1 and 131*b*2 of the first rotor housing cover 131 and shapes of the two channels 133*b*1 and 133*b*2 of the third rotor housing cover 133 may also overlap each other in the axial direction. In other words, the two channels 131*b*1 and 131*b*2 of the first rotor housing cover 131 and the two channels 133*b*1 and 133*b*2 of the third rotor housing cover 133 may have identical shapes, and may be arranged to overlap each other in a direction viewing the rotating shaft 110 from one end toward another end.

In addition, as the two channels 132*b*1 and 132*b*2 of the second rotor housing cover 132 and the two channels 134*b*1 and 134*b*2 of the fourth rotor housing cover 134 are at the first quadrant and the third quadrant, the two channels 132*b*1 and 132*b*2 of the second rotor housing cover 132 and the two channels 134*b*1 and 134*b*2 of the fourth rotor housing cover 134 may be at positions overlapping each other in the axial direction. In addition, shapes of the two channels 132*b*1 and 132*b*2 of the second rotor housing cover 132 and shapes of the two channels 134*b*1 and 134*b*2 of the fourth rotor housing cover 134 may also overlap each other in the axial direction. In other words, the two channels 132*b*1 and 132*b*2 of the second rotor housing cover 132 and the two channels 134*b*1 and 134*b*2 of the fourth rotor housing cover 134 may have identical shapes, and may be arranged to overlap each other in a direction viewing the rotating shaft 110 from one end toward another end.

Here, the shapes of the two channels 131*b*1 and 131*b*2, and 133*b*1 and 133*b*2 of the first and third rotor housing covers 131 and 133 and the shapes of the two channels 132*b*1 and 132*b*2, and 134*b*1 and 134*b*2 of the second and fourth rotor housing covers 132 and 134 may be symmetrical with respect to a straight line corresponding to x=0, on the coordinate plane. In other words, the channels formed inside the fluid transfer device 100 may be symmetrical, like the first rotor 171 and the second rotor 172, thereby greatly reducing generation of vibration due to the operation of the fluid transfer device 100.

Shapes of the two channels 131*b*1 and 131*b*2 of the first rotor housing cover 131 viewed from opposite sides of the first rotor housing cover 131 may be identical to each other. Shapes of the two channels 132*b*1 and 132*b*2 of the second rotor housing cover 132 viewed from opposite sides of the second rotor housing cover 132 may be identical to each other. Shapes of the two channels 133*b*1 and 133*b*2 of the third rotor housing cover 133 viewed from opposite sides of the third rotor housing cover 133 may be identical to each other. Shapes of the two channels 134*b*1 and 134*b*2 of the fourth rotor housing cover 134 viewed from opposite sides of the fourth rotor housing cover 134 may be identical to each other. Therefore, the two channels 131*b*1 and 131*b*2 of the first rotor housing cover 131, the two channels 132*b*1 and 132*b*2 of the second rotor housing cover 132, the two channels 133*b*1 and 133*b*2 of the third rotor housing cover 133, and the two channels 134*b*1 and 134*b*2 of the fourth rotor housing cover 134 may be formed through the circular plates or the polygonal plates while maintaining identical shapes in the axial direction.

The channel housing 135 may have a fluid communication space 135*b*1, 135*b*2, and the fluid communication space 135*b*1, 135*b*2 may include a first communication space 135*b*1 and a second communication space 135*b*2. The channel housing 135 may serve to transfer fluid introduced from the channel 132*b*1 of the second rotor housing cover 132 to the channel 133*b*1 of the third rotor housing cover 133 through the first communication space 135*b*1, and transfer fluid introduced through the channel 132*b*2 of the second rotor housing cover 132 to the channel 133*b*2 of the third rotor housing cover 133 through the second communication space 135*b*2.

The first communication space 135*b*1 may be configured to communicate the channel 132*b*1 on the first quadrant, of the two channels 132*b*1 and 132*b*2 of the second rotor housing cover 132, and the channel 133*b*1 on the second quadrant, of the two channels 133*b*1 and 133*b*2 of the third rotor housing cover 133, with each other.

The second communication space 135*b*2 may be configured to communicate the channel 132*b*2 on the third quadrant, of the two channels 132*b*1 and 132*b*2 of the second rotor housing cover 132, and the channel 133*b*2 on the fourth quadrant, of the two channels 133*b*1 and 133*b*2 of the third rotor housing cover 133, with each other.

The first communication space 135*b*1 and the second communication space 135*b*2 may have shapes identical to each other while having a point symmetry with respect to the rotating shaft 110. In addition, the shape of the first communication space 135*b*1 and the shape of the second communication space 135*b*2 may be symmetrical to each other.

With this structure, the first fluid entrance 141*a* and the second fluid entrance 142*a* may not communicate with each other while a volume of the variable-volume space formed in the first rotor housing 121 and a volume of the variable-volume space formed in the second rotor housing 122 are changing.

The fluid entrance housings 141 and 142 may be disposed at outermost sides of the fluid transfer device 100, respectively. The fluid entrance housings 141 and 142 may define a part of the outer circumferential surface of the fluid transfer device 100 and opposite side surfaces of the fluid transfer device 100.

The first fluid entrance housing 141 may be opened toward the first rotor housing cover 131. The second fluid entrance housing 142 may be opened toward the fourth rotor housing cover 134.

When fluid is introduced through the first fluid entrance 141*a* formed at the first fluid entrance housing 141, the rotating shaft 110 rotates in a first direction, which is a clockwise direction. The fluid introduced through the first fluid entrance 141*a* of the first fluid entrance housing 141 while the rotating shaft 110 is rotating in the first direction may be compressed in the first fluid compression space V1 and the second fluid compression space V2, sequentially, then discharged at high pressure through the second fluid entrance 142*a* of the second fluid entrance housing 142.

(a) of FIG. 5 is a front view of the first rotor housing 121, (b) of FIG. 5 is a perspective view of the first rotor housing 121, and (c) of FIG. 5 is a conceptual view illustrating the pothole 121*a* formed in the first rotor housing 121. In addition, (a) of FIG. 6 is a conceptual view illustrating a state in which the first rotor 171 is located in the first rotor housing 121, and (b) of FIG. 6 is a conceptual view illustrating a state in which the first rotor 171 moves inside the first rotor housing 121.

The fluid transfer device 100 according to the present disclosure may be configured to have a pothole 121*a* formed at the inner side surface of the first rotor housing 121 and a pothole 122*a* formed at the inner side surface of the second rotor housing 122.

The pothole 121*a*, 122*a* may include a first pothole 121*a* formed along the inner side surface of the first rotor housing 121 and a second pothole 122*a* formed along the inner side surface of the second rotor housing 122.

The first pothole 121*a* may have a recessed shape with a set depth along the inner side surface of the first rotor housing 121. The second pothole 122*a* may have a recessed shape with a set depth along the inner side surface of the second rotor housing 122.

As illustrated in (a) of FIG. 5, the first pothole 121*a* may be recessed from the inner side surface of the first rotor housing 121 in the shape of an epitrochoid curved surface.

The first pothole 121*a* may be formed at one side of the first rotor housing 121 within a range of an angle of approximately 'a' about a center of the first rotor housing 121, and may have a depth smaller than a thickness of the first rotor housing 121 so as to be formed in a region not deviating from the thickness of the first rotor housing 121. Here, the 'a' may be approximately 73 degrees.

In addition, as illustrated in (b) of FIG. 6, a center of the first pothole 121*a* in the first rotor housing 121 may form an angle of 90 degrees with an imaginary line passing through the center of the first rotor housing 121 and dividing the inner space having the shape of an epitrochoid surface into two symmetrical spaces. As illustrated in (b) of FIG. 6, a sum of a1, a2, and a3 may be 90 degrees.

In addition, the first pothole 121*a* may have a predetermined depth that is not greater than the thickness of the first rotor housing 121.

Likewise, the second pothole 122*a* may be recessed from the inner side surface of the second rotor housing 122 in the shape of an epitrochoid curved surface. The second pothole 122*a* may be formed at one side of the second rotor housing 122 within a range of an angle of approximately 'a' about a center of the second rotor housing 122, and may have a depth smaller than a thickness of the second rotor housing 122 so as to be formed in a region not deviating from the thickness of the second rotor housing 122. Here, the 'a' may be approximately 73 degrees.

In addition, the second pothole 122*a* may have a predetermined depth that is not greater than the thickness of the second rotor housing 122.

The first pothole 121*a* and the second pothole 122*a* may be disposed at positions facing each other with respect to the rotating shaft 110. For example, the first pothole 121*a* and the second pothole 122*a* may be disposed to have an angle of 180 degrees about the rotating shaft 110.

When the first rotor 171 rotates inside the first rotor housing 121, each of edges at which each of vertices of the first rotor 171 in a triangular pillar shape is located is moved while being brought into contact with the inner side surface of the first rotor housing 121.

Here, an edge at which a vertex of the first rotor 171 is located is not brought into contact with the inner side surface of the first rotor housing 121 due to the first pothole 121*a* formed along the inner side surface of the first rotor housing 121.

Similarly, when the second rotor 172 rotates inside the second rotor housing 122, each of edges at which each of vertices of the second rotor 172 in a triangular pillar shape is located is moved while being brought into contact with the inner side surface of the second rotor housing 122.

Here, an edge at which a vertex of the second rotor 172 is located is not brought into contact with the inner side surface of the second rotor housing 122 due to the second pothole 122*a* formed along the inner side surface of the second rotor housing 122.

For example, when the first rotor 171 rotates inside the first rotor housing 121, each of edges at which each of vertices of the second rotor 172 in a triangular pillar shape is located is moved while being brought into contact with the inner side surface of the first rotor housing 121, thereby allowing an inner space of the first rotor housing 121 to be divided into three spaces A1, A2, and A3.

However, as illustrated in (a) and (b) of FIG. 6, when the first rotor 171 rotates inside the first rotor housing 121, the inner side surface of the first rotor housing 121 and an end portion of the first rotor 171 are spaced apart from each other and not brought into contact with each other at a position at which the first pothole 121*a* is formed, and therefore, the space A2 and the space A3 may not be separated from each other by the first rotor 171 and may be communicated with each other.

In other words, as the first rotor 171 rotates inside the first rotor housing 121, changes in the spaces A1, A2, and A3 inside the first rotor housing 121 may show an aspect different from that of a case without the first pothole 121*a*.

When the first pothole 121*a* is formed in the first rotor housing 121 as illustrated in (a) and (b) of FIG. 6, the space A2 and the space A3 may be communicated with each other when each of the vertices of the triangular first rotor 171 is positioned at the first pothole 121*a* as the first rotor 171 rotates inside the rotor housing 121.

In the case where the first pothole 121*a* is formed at the inner side surface of the first rotor housing 121, when a vertex of the first rotor 121 is positioned in the first pothole 121*a*, the space A2 and the space A3 may be communicated with each other and a sum of a reduced volume of the space A2 and an increased volume of the space A3 may be constant, and therefore, there will be no change in the pressure of the fluid accommodated in the space A2 and the space A3. However, the space A1 may be changed in a way same as the case without the first pothole 121*a*.

In addition, in the same manner as described above, although not directly illustrated in the drawings, when the second rotor 172 rotates inside the second rotor housing 122, the inner side surface of the second rotor housing 122 and an end portion of the second rotor 172 are spaced apart from each other and not brought into contact with each other at a position at which the second pothole 122*a* is formed. And thus, each of the inner spaces may be changed in the same way as when the first pothole 121*a* is formed in the first rotor housing 121 described above.

Here, fluid may not be discharged through the outlet 142*a*, and when a vertex of the first rotor 171 is not positioned in the first pothole 121*a*, the pressure of the fluid rises to increase flow velocity due to the change in the spaces A1, A2, and A3, to thereby achieve a greater pulsation of fluid.

On the other hand, in the case where the first pothole 121*a* is not formed in the first rotor housing 121, when the rotating shaft 110 rotates clockwise, the volume of the space A2 decreases, the volume of the space A3 increases, and the volume of the space A1 decreases. However, a sum of volumes of spaces A1, A2, and A3 may always be kept constant. A fluid transfer may be performed in response to the volume change in the space partitioned inside the first rotor housing 121, and thus, a change in flow velocity of fluid being introduced into the fluid transfer device may be the same as a change in flow velocity of fluid being discharged from the fluid transfer device.

In other words, in the fluid transfer device 100, fluid may be transferred as the volume of the space partitioned inside the rotor housings 121 and 122 changes while the first rotor 171 and the second rotor 172 symmetrically positioned 180 degrees apart with respect to the rotating shaft 110 are rotating in the rotor housings 121 and 122, therefore, pulsation may inevitably occur during the operation. However, since a range of change in the pulsation is relatively not large, the pulsation may not occur significantly compared to a case in which the existing diaphragm or piston method is used.

(a) of FIG. 7 is a conceptual view illustrating a rear surface portion of the fourth rotor housing cover 134, and (b) of FIG. 7 is a conceptual view illustrating a front surface portion of the fourth rotor housing cover 134.

The discharge valve 134*a* may be installed on the fourth rotor housing cover 134 to open and close the channel 134*b*1, 134*b*2.

When fluid is introduced through the first fluid entrance (or inlet) 141*a* formed at the first fluid entrance housing 141, the rotating shaft 110 rotates in a first direction, which is a clockwise direction. The fluid introduced through the first fluid entrance 141*a* of the first fluid entrance housing 141 while the rotating shaft 110 is rotating in the first direction may be compressed in the first fluid compression space V1 and the second fluid compression space V2, sequentially, then discharged through the second fluid entrance (or outlet) 142*a* of the second fluid entrance housing 142.

As illustrated in (a) and (b) of FIG. 7, one surface of the fourth rotor housing cover 134 may face the second fluid compression space V2, another surface of the fourth rotor housing cover 134 may face the second fluid entrance housing 142, and the fourth rotor housing cover 134 may cover the second fluid compression space V2.

Here, fluid compressed in the fluid compression spaces V1 and V2 may pass through the channels 134*b*1 and 134*b*2 formed in the fourth rotor housing cover 134 to be sprayed toward outside through the second fluid entrance (or outlet) 142*a* formed at the second fluid entrance housing 142. Here, the second fluid entrance (or outlet) 142*a* may protrude forwardly of the second fluid entrance housing 142 to have a funnel-like shape.

Here, the fourth rotor housing cover 134 may be provided with the discharge valve 134*a* to allow compressed fluid to be discharged through the outlet 142*a*. One side of the discharge valve 134*a* may be fixed to the fourth rotor housing cover 134 to cover and selectively open and close the channels 134*b*1 and 134*b*2 formed in the fourth rotor housing cover 134.

The discharge valve 134*a* may be provided in plurality to cover and open and close each of the channels 134*b*1 and 134*b*2, and each of the discharge valves 134*a* may be alternately opened and closed to discharge the compressed fluid in response to the movement of the rotors 171 and 172.

In addition, the discharge valve 134*a* serves to prevent the fluid transferred to the second fluid entrance housing 142 through the channels 134*b*1 and 134*b*2 from flowing backward to be transferred to the second rotor housing 122. For example, the discharge valve 134*a* may refer to a check valve, but this is only an example.

FIG. 8 is a conceptual view sequentially illustrating a process in which fluid introduced into the fluid transfer device 100 is discharged. Here, changes in open/closed states of channels and changes in volumes of variable-volume spaces, in response to the movement of the rotors 171 and 172 are sequentially illustrated. And, FIG. 9 is a graph showing variations of outflow amount of fluid generated according to rotation degrees.

Hereinafter, the operation of the fluid transfer device 100 will be described.

The fluid transfer device 100 may transfer the fluid in the first fluid compression space V1 to the second fluid compression space V2 according to the rotating direction of the rotating shaft 110, and then allow the fluid to pass the second fluid entrance housing 142 to be discharged outside through the outlet 142*a*.

Drawings from top to bottom in FIG. 8 sequentially shows how the fluid transfer device 100 operates every time the rotating shaft 110 rotates by 90 degrees in the first direction, which is the clockwise direction.

Drawings on the left in FIG. 8 illustrate a state in which the first rotor housing cover 131, the first rotor 171, the first rotor housing 121, and the second rotor housing cover 132 are projected in a direction viewing the rotating shaft 110 from one end toward another end.

And, drawings on the right in FIG. 8 illustrate a state in which the third rotor housing cover 132, the second rotor 172, the second rotor housing 122, and the fourth rotor housing cover 134 are projected in a direction viewing the rotating shaft 110 from one end toward another end.

When the rotating shaft 110 rotates in the first direction, which is a clockwise direction, the fluid may be compressed according to the order illustrated in FIG. 8. The fluid may be compressed first in the first fluid compression space V1 and then compressed in the second fluid compression space V2.

When the fluid transfer device 100 continuously operates, the process of (a) to (d) of FIG. 8 may be continuously repeated. A1, B1, and C1 each may denote a variable-volume space defined by three sides of the first rotor 171. Similarly, A2, B2, and C2 each may denote a variable-volume space defined by three sides of the second rotor 172.

In the fluid transfer device 100, fluid may be transferred as the volume of the space partitioned inside the rotor housings 121 and 122 changes while the first rotor 171 and the second rotor 172 symmetrically positioned 180 degrees apart with respect to the rotating shaft 110 are rotating in the rotor housings 121 and 122. Pulsation may occur in such a fluid transfer process.

As illustrated in (a) of FIG. 8, when the rotating shaft 110 rotates from 0 degrees, which is an initial state, to 90 degrees, the volume of the space A2 and the volume of the space B2 inside the second rotor housing 122 may decrease, and the volume of the space C1 inside the first rotor housing 121 communicated with the space A2 by the channel 132*b*2 and the channel 133*b*2 may decrease. Accordingly, an amount of fluid equal to a sum of reduced volumes of spaces A2, B2, and C1 may be discharged (outflow amount of fluid=volume change amount of A2+volume change amount of B2+volume change amount of C1).

The fluid transfer device 100 may operate to allow fluid to be discharged and introduced. While the rotating shaft rotates from the initial state to 90 degrees as illustrated in (a) of FIG. 8, the volume of the space A1 of the first rotor housing 121 increases, and for a space B1 and a space C2 communicated through the channel 132*b*1 and the channel 133*b*1, the volume of the space B1 decreases and the volume of the space C2 increases.

In other words, when operating as illustrated in (a) of FIG. 8, a sum of the volume of the space B1 and the volume of the space C2 increases as an increased volume of the space C2 is relatively large compared to a decreased volume of the space B1. And thus, fluid may be introduced through the channel 131*b*1 communicated with the channel housing 135.

Accordingly, while operating as in (a) of FIG. 8, an inflow amount of fluid will be determined by an increased volume of the space A1, an increased volume of the space C2, and a decreased volume of the space B1 (inflow amount of fluid=volume change amount of A1+volume change amount of C2−volume change amount of B1).

(b) of FIG. 8 is a conceptual view illustrating a state in which the rotating shaft 110 is rotating from 90 degrees to 180 degrees.

As illustrated in (b) of FIG. 8, while the rotating shaft 110 is rotating, positions of the first rotor 171 and the second rotor 172 change, thereby transforming the channels. And accordingly, an aspect in which fluid flowing in and out is changed. For example, as illustrated in (b) of FIG. 8, end portions of the first rotor 171 and the second rotor 172 may pass each of the pothole 121*a* and the pothole 122*a*, in the first rotor housing 121 and the second rotor housing 122. The space B1 and the space C1 may be in communication with each other, and in communication with the space C2 through the channels 132*b*1 and 133*b*1. The volume of the space B1 decreases, the volume of the space C1 increases, and the volume of the space C2 increases. Here, as a volume change amount of the space B1 is equal to a sum of a volume change amount of the space C1 and a volume change amount of the space C2, volume change may not occur (outflow amount of fluid=volume change amount of B1−volume change amount of C1−volume change amount of C2).

In addition, the space A2 and the space B2 may be in communication with each other, and in communication with the space A1 through the channels 132*b*2 and 133*b*2. The volume of the space A2 decreases, the volume of the space B2 increases, and the volume of the space A1 increases. Here, as a volume change amount of the space A2 is equal to a sum of a volume change amount of the space A1 and a volume change amount of the space B2, volume change may not occur (outflow amount of fluid=volume change amount of A2−volume change amount of A1−volume change amount of B2).

When the rotating shaft 110 rotates from 180 degrees to 270 degrees as illustrated in (c) of FIG. 8, end portions of the first rotor 171 and the second rotor 172 may pass each of the pothole 121*a* and the pothole 122*a* in the first rotor housing 121 and the second rotor housing 122, like (b) of FIG. 8. Therefore, the space B1 and the space C1 may be in communication with each other, and in communication with the space C2 through the channels 132*b*1 and 133*b*1. The volume of the space B1 decreases, the volume of the space C1 increases, and the volume of the space C2 decreases unlike (b) of FIG. 8. Here, as a volume change amount of the space C1 is equal to a sum of a volume change amount of the space B1 and a volume change amount of the space C2, volume change may not occur (outflow amount of fluid=volume change amount of C1−volume change amount of B1−volume change amount of C2).

In addition, the space A2 and the space B2 may be in communication with each other, and in communication with the space A1 through the channels 132*b*2 and 133*b*2. The volume of the space A2 decreases, the volume of the space B2 increases, and the volume of the space A1 decreases. Here, as a volume change amount of the space B2 is equal to a sum of a volume change amount of the space A1 and a volume change amount of the space A2, volume change may not occur (outflow amount of fluid=volume change amount of B2−volume change amount of A1−volume change amount of A2).

In other words, while the rotating shaft 110 rotates from 90 degrees to 270 degrees, volume change in inner spaces of the first rotor housing 121 and the second rotor housing 122 may not occur.

(d) of FIG. 8 illustrates a state in which the rotating shaft is rotating from 270 degrees to 360 degrees. Through a process of changing from (c) of FIG. 8 to (d) of FIG. 8, positions of the first rotor 171 and the second rotor 172 change, thereby transforming the channels.

In a process in (d) of FIG. 8, end portions of the first rotor 171 and the second rotor 172 may not pass each of the pothole 121*a* and the pothole 122*a* in the first rotor housing 121 and the second rotor housing 122, and therefore, fluid as much as an amount of internal volume change in each of the rotor housings 121 and 122 may be transferred.

As illustrated in (d) of FIG. 8, the volume of the space C2 of the second rotor housing 122 continues to decrease, the volume of the space B2 increases, and the volume of the space A2 is changed to be increased. At the same time, the volume of the space A1 of the first rotor housing 121 decreases, the volume of the space B1 is changed to be increased, and the volume of the space C1 continues to increase.

Here, as the space A1 and the space B2 communicate through the channel 132*b*2 and the channel 133*b*2, the decreased volume of the space A1 may be greater than the increased volume of the space B2, thereby making a sum of a volume change amount of the space B2 and a volume change amount of the space A1 to be decreased. Accordingly, fluid will be discharged to the second fluid entrance housing 142 through the channel 134*b*2.

Since the inner surface of each of the rotor housings 121 and 122 has an epitrochoid curve, an equation for the epitrochoid curve follows a sinusoidal curve, and volume change in the space divided into three by each of the rotors 171 and 172 may follow a sinusoidal curve as the rotors 171 and 172 rotate clockwise.

For example, the volume change of the space A1 follows a sinusoidal curve, and the volume changes of the spaces B1 and C1 also follow a sinusoidal curve like the volume change of the space A1. The volume change in the spaces A1, B1, and C1 has a phase difference of 180 degrees with respect to the rotation degree of the rotating shaft 110, and an amount of fluid discharged from the fluid transfer device 100 will be as much as the volume change amount in each of the variable volume spaces.

However, since the fluid transfer device 100 according to the present disclosure has a structure in which the potholes 121*a* and 122*a* are formed on the inner side surfaces of the first rotor housing 121 and the second rotor housing 122, fluid may be transferred only in a section in (a) of FIG. 8 where a rotation degree of the rotating shaft 110 is from 0 to 90 degrees and in a section in (d) of FIG. 8 where the rotation degree of the rotating shaft 110 is from 270 to 360 degrees. And, fluid may not be transferred in sections in (b) and (c) of FIG. 8 where the rotation degree of the rotating shaft 110 is from 90 to 270 degrees.

Change in flow velocity according to the rotation degree of the rotating shaft 110 of the fluid transfer device 100 may be represented as in FIG. 9. And, since fluid may be transferred only within sections where the rotation degree of the rotating shaft 110 is from 0 to 90 degrees, and from 270 to 360 degrees due to the structure in which the potholes 121*a* and 122*b* are formed in the rotor housings 121 and 122, relatively greater pulsation can be generated. Since a width of pulsation can be expanded by such a pulsation stream, the fluid transfer device 100 can be applied in a variety of fields including a blood dialyzing apparatus, a fountain device, a washer, an oral cleaner, a medical device, or a skincare or haircare device requiring improvement in pulsation performance such as low noise and low vibration.

FIG. 10 is a view illustrating various modified embodiments of the pothole 121*a* formed on the inner side surface of the first rotor housing 121.

As described above, fluid transfer of the fluid transfer device 100 may be achieved by volume change due to the eccentric rotation of the first rotor 171 and the second rotor 172 located in the first rotor housing 121 and the second rotor housing 122. Fluid introduced into the first fluid entrance housing 141 through the first fluid entrance 141*a* may pass the first rotor housing 121 and the second rotor housing 122 through the channels 131*b*1 and 131*b*2 of the first rotor housing cover 131 to be introduced into the second fluid entrance housing 142 through the channels 134*b*1 and 134*b*2 of the fourth rotor housing cover 134, then discharged through the second fluid entrance 142*a* provided at the second fluid entrance housing 142.

With this process, fluid in the fluid transfer device 100 may be discharged through the first fluid entrance 141*a* or the second fluid entrance 142*a* while discharge change amount has a constant amplitude, and such a discharge change amount may generate pulsation of the transfer device 100.

In the fluid transfer device 100 according to the present disclosure, the inner side surfaces of the first rotor housing 121 and the second rotor housing 122 may be provided with the potholes 121*a* and 122*a*, and locations, lengths, widths, and numbers of the potholes 121*a* and 122*b* formed on the inner side surfaces of the rotor housings 121 and 122 may be variously modified by a user. For example, as illustrated in FIG. 10, a position, size, width, and number of the porthole 121*a* formed inside the first rotor housing 121 may be determined according to a fluid pulsation desired by a user. As illustrated in (a) to (d) of FIG. 10, by forming a porthole 121*a* in various shapes on the inner side surface of the first rotor housing 121, pulsation having various waveforms may be generated. Although not illustrated in the drawing, it is also possible to further diversify the pulsation waveform by variously combining the portholes formed in the first rotor housing 121 and the second rotor housing 122.

The fluid transfer device described above is not limited to the configurations and the methods of the embodiments described above, but the embodiments may be configured by selectively combining all or part of the embodiments so that various modifications or changes can be made.

What is claimed is:

1. A fluid transfer device, comprising:

a first fluid entrance housing into which fluid is introduced through an inlet formed at one side of the first fluid entrance housing, and a second fluid entrance housing disposed to be spaced apart from the first fluid entrance housing and configured to compress and discharge the introduced fluid;

a rotating shaft comprising a rotating portion extending in an axial direction, and a first eccentric portion and a second eccentric portion disposed to be spaced apart from each other along the rotating portion;

a first rotor housing defining a first fluid compression space having an epitrochoid surface;

a second rotor housing defining a second fluid compression space having an epitrochoid surface, and disposed to be spaced apart from the first rotor housing in the axial direction;

a first rotor disposed in the first fluid compression space so as to divide the first fluid compression space into a plurality of variable-volume spaces, and coupled to the first eccentric portion while surrounding the first eccentric portion in a radial direction of the first eccentric portion;

a second rotor disposed in the second fluid compression space so as to divide the second fluid compression space into a plurality of variable-volume spaces, and coupled to the second eccentric portion while surrounding the second eccentric portion in a radial direction of the second eccentric portion;

rotor housing covers disposed to cover opposite surfaces of the first rotor housing and opposite surfaces of the second rotor housing, respectively; and a channel housing disposed between the first rotor housing and the second rotor housing to define a fluid communication space, wherein an inner side surface of the first rotor housing and an inner side surface of the second rotor housing are each provided with a pothole, wherein the channel housing provides a channel so that fluid in the first fluid compression space and fluid in the second fluid compression space move between the first rotor housing and the second rotor housing through the fluid communication space, and wherein the rotor housing covers comprises:

a first rotor housing cover configured to cover the first fluid compression space and disposed at one side of the first rotor housing;

a second rotor housing cover disposed between the first rotor housing and the channel housing so as to cover the first fluid compression space and the fluid communication space;

a third rotor housing cover configured to cover the fluid communication space and disposed between the channel housing and the second rotor housing; and a fourth rotor housing cover disposed on an opposite side of the third rotor housing cover with respect to the second rotor housing so as to cover the second fluid compression space.

2. The fluid transfer device of claim 1, wherein the pothole comprises:

a first pothole formed along the inner side surface of the first rotor housing; and a second pothole formed along the inner side surface of the second rotor housing.

3. The fluid transfer device of claim 2, wherein the first pothole and the second pothole are disposed to face each other with respect to the rotating shaft.

4. The fluid transfer device of claim 3, wherein the first pothole and the second pothole are disposed to have an angle of 180 degrees with respect to the rotating shaft.

5. The fluid transfer device of claim 2, wherein the first pothole has a preset thickness so that an end portion of the first rotor is spaced apart from the inner side surface of the first rotor housing.

6. The fluid transfer device of claim 2, wherein the second pothole has a preset thickness so that an end portion of the second rotor is spaced apart from the inner side surface of the second rotor housing.

7. The fluid transfer device of claim 1, wherein fluid accommodated in the first fluid compression space is transferred to the second fluid compression space according to a rotating direction of the rotating shaft.

8. The fluid transfer device of claim 1, wherein the first rotor housing is installed adjacent to the first fluid entrance housing, and the second rotor housing is installed adjacent to the second fluid entrance housing.

9. The fluid transfer device of claim 1, wherein the fourth rotor housing cover is provided with a discharge valve so as to limit fluid transferred to the second fluid entrance housing from flowing back to the second rotor housing.

10. The fluid transfer device of claim 1, wherein the first eccentric portion and the second eccentric portion are disposed to have an angle of 180 degrees with respect to the rotating portion, and wherein the first rotor housing and the second rotor housing are disposed such that each of the epitrochoid surfaces face the same direction.

11. The fluid transfer device of claim 1, wherein the first rotor and the second rotor are symmetrically positioned 180 degrees apart with respect to the rotating shaft.

12. The fluid transfer device of claim 1, wherein the first rotor housing cover, the second rotor housing cover, the third rotor housing cover, and the fourth rotor housing cover each comprises:

a rotating shaft through hole formed in the axial direction through a center of a plate defining the first rotor housing cover, the second rotor housing cover, the third rotor housing cover, or the fourth rotor housing cover to receive the rotating portion; and two channels formed symmetrically with each other with respect to the rotating shaft through hole and allowing fluid to pass therethrough in the axial direction.

13. The fluid transfer device of claim 12, wherein, when the rotating shaft through hole lies on an origin of a coordinate plane in a direction viewing the rotating shaft from one end toward another end, one of the two channels of the first rotor housing cover lies on a second quadrant, and another one of the two channels of the first rotor housing cover lies on a fourth quadrant, one of the two channels of the second rotor housing cover lies on a first quadrant, and another one of the two channels of the second rotor housing cover lies on a third quadrant, one of the two channels of the third rotor housing cover lies on the second quadrant, and another one of the two channels of the third rotor housing cover lies on the fourth quadrant, and one of the two channels of the fourth rotor housing cover lies on the first quadrant, and another one of the two channels of the fourth rotor housing cover lies on the third quadrant.

14. The fluid transfer device of claim 13, wherein the communication space further comprises:

a first communication space configured to communicate the channel on the first quadrant, of the two channels of the second rotor housing cover, and the channel on the second quadrant, of the two channels of the third rotor housing cover, with each other; and a second communication space configured to communicate the channel on the third quadrant, of the two channels of the second rotor housing cover, and the channel on the fourth quadrant, of the two channels of the third rotor housing cover, with each other.

15. The fluid transfer device of claim 12, wherein the two channels of the first rotor housing cover and the two channels of the third rotor housing cover have identical shapes, and are arranged to overlap each other in a direction viewing the rotating shaft from one end toward another end, and wherein the two channels of the second rotor housing cover and the two channels of the fourth rotor housing cover have identical shapes, and are arranged to overlap each other in the direction viewing the rotating shaft from one end toward another end.

* * * * *